US005660026A

United States Patent [19]

Kinigakis et al.

[11] Patent Number: 5,660,026

[45] Date of Patent: Aug. 26, 1997

[54] METHOD AND APPARATUS FOR PROVIDING A PACKAGE DISPLAY CASE

[75] Inventors: Panagiotis Kinigakis, West Windsor, N.J.; Steve R. Wisnasky, Collinsville, Ill.; William A. McGovern; John J. McGovern, both of Jamesburg, N.J.

[73] Assignee: Kraft Foods, Inc., Northfield, Ill.

[21] Appl. No.: 548,310

[22] Filed: Nov. 2, 1995

[51] Int. Cl.[6] ..... B65B 35/30

[52] U.S. Cl. ..... 53/448; 53/48.8; 53/156; 53/250; 53/251; 53/398; 53/534; 53/543; 53/580

[58] Field of Search ..... 53/48.1, 48.6, 53/48.7, 48.8, 155, 156, 157, 238, 170, 171, 250, 251, 534, 543, 398, 580, 445, 448, 474

[56] References Cited

U.S. PATENT DOCUMENTS

| | | | |
|---|---|---|---|
| 2,276,129 | 3/1942 | Wesselman | 53/398 |
| 2,998,685 | 9/1961 | Ganz | 53/48.7 X |
| 3,061,986 | 11/1962 | Paps | 53/48.8 X |
| 3,187,479 | 6/1965 | Ganz | 53/48.8 X |
| 3,332,200 | 7/1967 | Englander | 53/251 X |
| 3,601,952 | 8/1971 | Cato | 53/534 X |
| 4,100,715 | 7/1978 | Ganz | 53/48.7 |
| 4,441,611 | 4/1984 | Sommariva | 206/460 X |
| 4,727,708 | 3/1988 | Conforto et al. | 53/534 |
| 4,748,791 | 6/1988 | Langenbeck | 53/251 X |
| 4,949,531 | 8/1990 | Largenbeck et al. | 53/251 X |
| 5,197,261 | 3/1993 | Hartness et al. | 53/534 |
| 5,241,805 | 9/1993 | Johnson | 53/251 X |

*Primary Examiner*—Daniel Moon

*Attorney, Agent, or Firm*—Thomas R. Savoie; Thomas A. Marcoux

[57] ABSTRACT

A method and apparatus for automatically providing a display case for a plurality of packages includes an assembly station at which the packages are initially assembled into an array. The array is then moved to a covering station. At the same time, a shroud is formed which shroud covers a top and two opposed first sides of the array while leaving two opposed second sides of the array uncovered. Forming of the shroud includes initially bending a blank so that a partially-formed shroud is produced having a top panel and two opposed side panels formed in a plane, and finally bending and locating the partially formed shroud relative to the array at the covering station such that a fully covered array is provided with the top panel and side panels covering a majority of the respective top and first sides of the array. Finally, the covered array is placed in a tray at a finishing station to provide the display case.

13 Claims, 6 Drawing Sheets

10
10'
12
12'
18
24a
24b
34a
34b
36a
36b
38a
38b
40a
40b 10
10'
12
12'
18
24a
24b
34a
34b
36a
36b
38a
38b
40a 10
10'
12
12'
18
24a
34a
36a
38a

METHOD AND APPARATUS FOR PROVIDING A PACKAGE DISPLAY CASE

FIELD OF THE INVENTION

The present invention relates generally to the protection of packages or products shipped in groups, and more particularly to a method and apparatus for automatically providing a display case which is used to protect the array of packages or products while leaving two opposed sides of the array open for viewing.

BACKGROUND OF THE INVENTION

When shipping products or packages (hereafter packages) which have little strength, it is necessary to protect the packages with a suitably strong shipping/storage case. Typically, it is desired to use corrugated board for such cases, which is a relatively cheap material and lends itself to automation. However, it may also be desirable to display the package in the case (for ready identification by the user) and to afford easy access to the packages. Various cases have been disclosed in the art for this purpose.

For example, KOOL-AID BURSTS® (comprising a fruit-flavored beverage in a plastic bottle with a flexible neck and twist-off top) have been shipped in a shrink-wrapped display case comprising top and bottom cardboard trays about a 4×2 array of six-packs of the KOOL-AID BURSTS®. A supporting divider is also provided between the array to vertically support the display case as the KOOL-AID BURSTS® bottles themselves have little vertical strength (as the twist-off tops and necks are flexible and readily subject to damage by impact). However, the provision of such display cases is not readily automatable and hence is labor intensive.

SUMMARY OF THE INVENTION

In accordance with the present invention, a method and apparatus for automatically providing a display case for a plurality of packages is provided using suitable steps and apparatus to perform the needed functions. At an assembly station, an array of the packages is assembled using an assembling means with the array split into first and second portions with a space therebetween. The first and second portions with the space therebetween are then moved by a first moving means from the assembling station to a covering station. At the same time as the array of packages is assembled, a shroud for the display case is formed by a forming means. The shroud will ultimately cover a top and two opposed first sides of the array of packages while leaving two opposed second sides of the array uncovered. Forming of the shroud includes (a) providing a blank of the shroud, (b) initially bending the blank with an initial bending means so that a partially-formed shroud is produced having a top panel and two opposed side panels formed in a plane together with a leg extending perpendicularly from the plane in the middle of each side panel, and (c) finally bending and locating the partially formed shroud relative to the first and second portions of the array at the covering station with a final bending means such that a fully covered array is provided with the legs of the side panels located in the space while the top panel and side panels cover a majority of the respective top and first sides of the array. The first and second portions of the array are then pushed together inside of the shroud by a pushing means so that the top panel and side panels cover all of the respective top and first sides of the array to form a covered array. Finally, the covered array is placed in a tray having a bottom and four upstanding sides at a finishing station by a placing means to provide the display case.

In a preferred embodiment, assembling of the array includes (a) conducting first and second lines of packages to the assembling station with a conducting means, and (b) forming the respective first and second portions of the array at the assembling station with the space therebetween from the packages conducted by the respective first and second lines with a second forming means. Preferably, the conducting of the packages includes the conveying of the first and second lines of packages along a conveyor double file while the moving of the first and second portions from the assembly station to the covering station occurs perpendicular to the conveyor. The first and second portions are also conveniently configured with packages having a two by two configuration by the second forming means.

Also in the preferred embodiment, the initial bending of the blank by the initial bending means includes (a) bending a reinforcing panel attached to each side panel perpendicular to the associated side panel, and bending a leg panel attached to each reinforcing panel perpendicular to the associated reinforcing panel, (b) applying glue to one of each reinforcing panel or each side panel, (c) bending the reinforcing panel attached to each side panel into position adjacent the associated side panel whereby associated leg panels are moved into facing engagement with one anther, and (d) pressing each reinforcing panel and associated side panel together so that each associated side panel and reinforcing panel are glued to one another and the associated leg panels are pressed against one another.

The initial bending preferably also includes (a) bending a respective squaring panel attached to respective opposite sides of the top panel perpendicular to the top panel, (b) applying glue to one of each squaring panel or both opposite sides of the top panel, (c) bending each squaring panel into position adjacent the top panel, and (d) pressing the squaring panels against the top panel so that the squaring panels are glued to the top panel and reinforce the top panel.

Further in the preferred embodiment, the final bending of the partially formed shroud by the final bending means includes (a) bending the partially formed shroud into the shroud above the first and second portions at the covering station, and (b) lowering the shroud onto the first and second portions with the legs in the space between the first and second portions and the top panel adjacent to a top of the packages of the first and second portions.

Still further in the preferred embodiment, the pushing of the first and second portions together in the shroud by the pushing means includes (a) moving an arm laterally against a distal end of one of the first and second portions distant from the finishing station and toward the finishing station whereby the first and second portions are gathered together under the shroud to form the covered array and the covered array is moved by the arm to the finishing station, and (b) as the covered array is moved, pressing down on the top panel to hold the shroud in place.

Still further in the preferred embodiment, the placing of the covered array in the tray by the placing means includes (a) moving the covered array to the finishing station so that there is a leading edge of one of the portions and a trailing edge of the other portion, (b) moving the leading edge of the one portion into one of the upstanding sides of the tray constituting a leading side so that the tray is moved along underneath the covered array at the finishing station, and (c) dropping the trailing edge of the covered array into the tray adjacent the upstanding side of the tray constituting a trailing side opposite the leading side. Preferably, this placing by the placing means further includes (a) feeding the tray for the covered array from below and through a gap in a horizontal slideway along which the covered array is moved by a feeding means, the leading side of the tray being uppermost so that the leading edge of the covered array moves into the leading side, (b) tilting an upstream portion of the slideway relative to the gap downwards into the tray therebelow by a first tilting means as the leading edge of the covered array approaches the leading side of the tray, (c) tilting a downstream portion of the slideway relative to the gap upwards by a second tilting means so that after the leading edge of the covered array pushes against the leading side of the tray the covered array and tray move upwards along the downstream portion of the slideway as the tray moves up through the gap, and (d) tilting the upstream portion back to horizontal with the first tilting means as the trailing side of the tray passes through the gap, which causes the trailing edge of the other portion to be raised above the bottom of the tray. From this position, pushing of the trailing edge of the other portion off of the upstream portion of the slideway by a pushing means of the dropping means causes the trailing edge of the other portion to drop inside of the trailing side of the tray to form the display case. Returning of the downstream portion of the slideway back to horizontal is then accomplished with the second tilting means, and moving of the formed display case from the finishing station along the slideway is accomplished with the second moving means. As the trailing edge of the other portion drops into the tray, the top panel of the shroud is pressed down with a pressing means.

It is an object of the present invention to provide a method and apparatus for automatically providing a display case for packages which provides a maximum amount of package access while still affording sufficient protection for the packages.

It is also an object of the present invention to automatically provide a display case with a maximum package display.

It is a further object of the present invention to automatically construct and fill a display case.

It is another object of the present invention to automatically provide a display case which has high strength to protect the packages during distribution and warehousing.

It is still another object of the present invention to provide a display case which is accessed on a side thereof without tearing of a corrugated panel.

Other features and objects of the present invention are stated in or apparent from detailed descriptions of presently preferred embodiments of the invention found hereinbelow.

Figure 8:
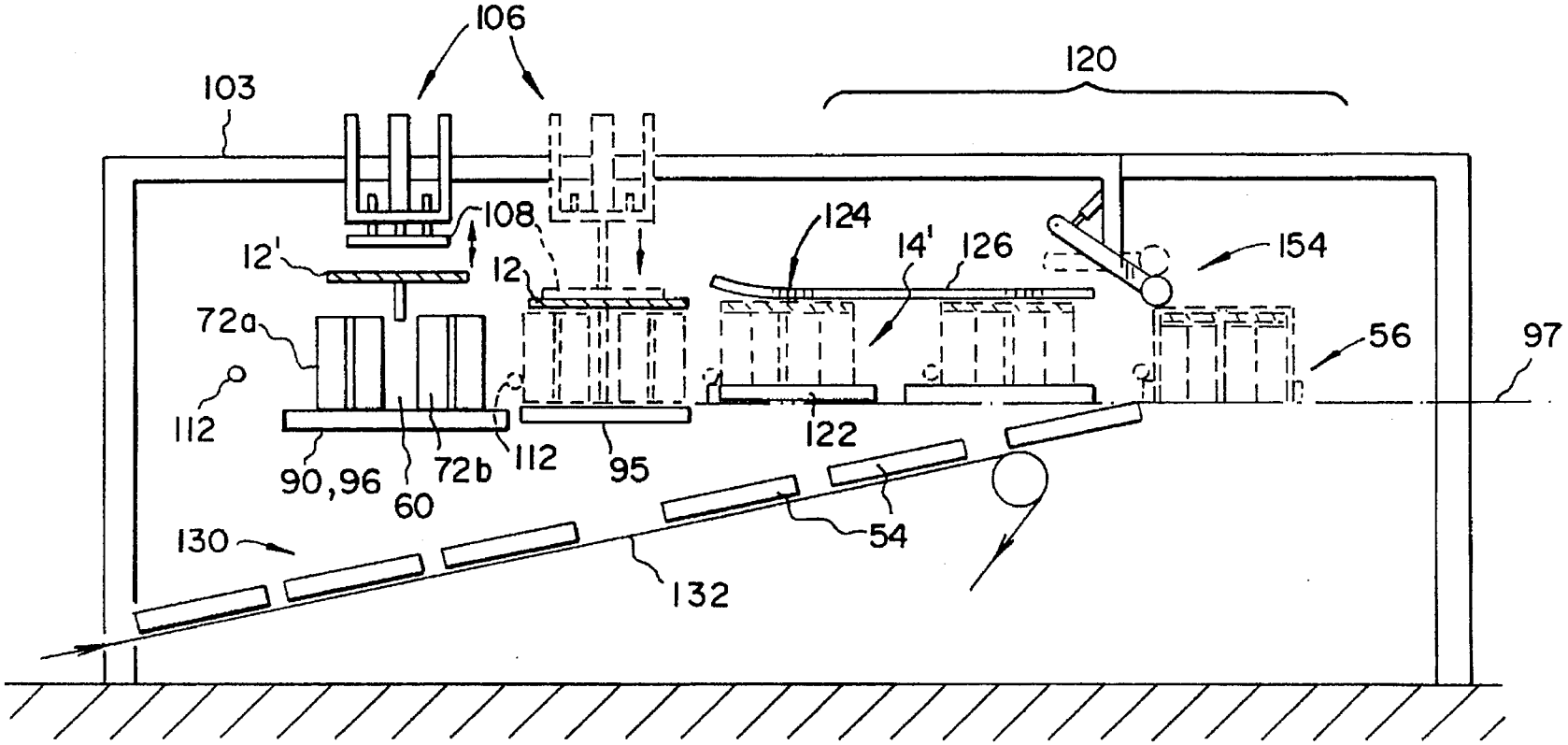
FIG. 8 is a schematic elevation view of the slideway portion of the system depicted in FIG. 7.

FIGS. *9a–9e* are schematic elevation views a portion of the slideway depicted in FIG. 8 showing the steps leading to formation of the display case.

DETAILED DESCRIPTION OF THE PREFERRED EMBODIMENTS

Figure 3:
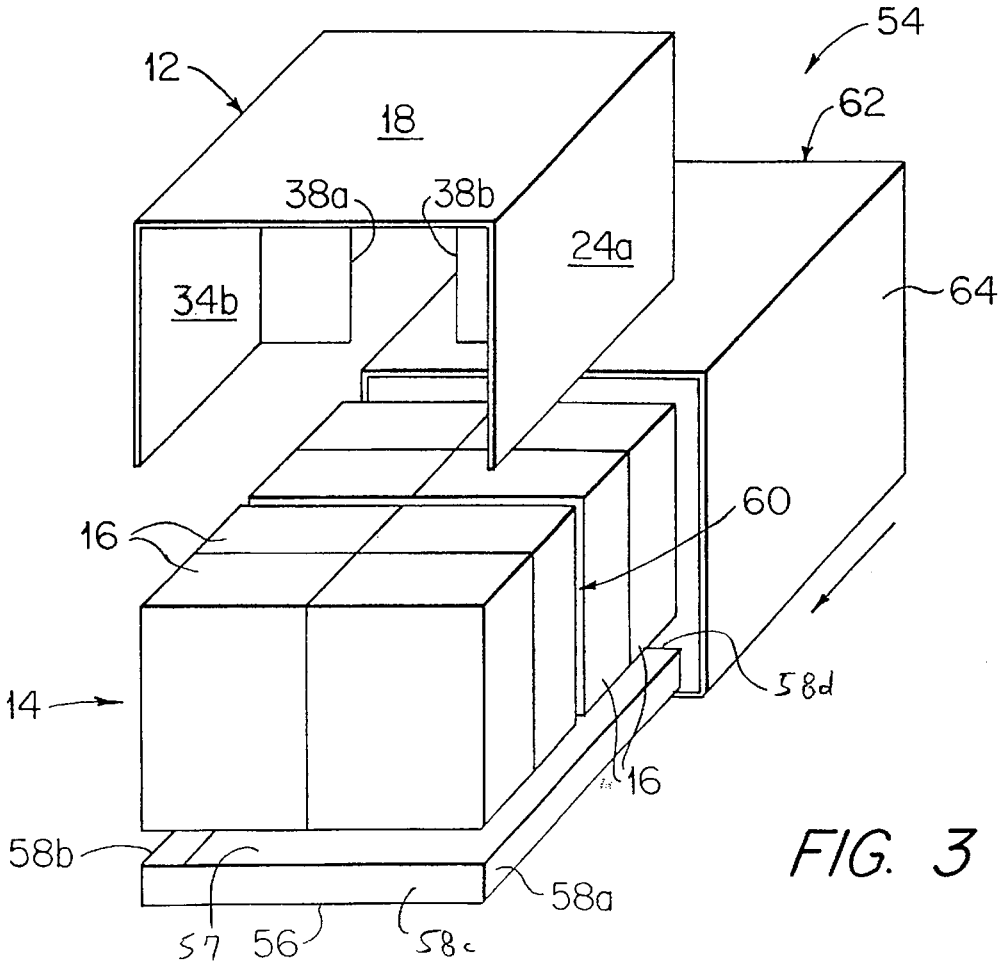
FIG. 3 is an exploded top perspective view of the shroud as well as the other elements of a display case according to the present invention.

With reference now to the drawings in which like numerals represent like elements throughout the views, it will initially be appreciated that the present invention provides a method and apparatus for forming a display case 54 for a plurality of packages 16, and thus an automatable method and apparatus for continuously forming such display cases at a rate of at least 12 per minute. As shown in FIG. 3, display case 54 for an array or matrix 14 of packages 16 is formed of a shroud 12, a bottom tray 56, and a securing means 62 such as a shrink-wrap sleeve 64. Blank 10, shroud 12, and display case 54 containing an array 14 of packages 16 have been disclosed in U.S. Pat. application Ser. No. 08/424,952 filed Apr. 19, 1995, which prior application is hereby incorporated by reference. As depicted, display case 54 is used for enclosing a 4×2 array 14 of packages 16 which, for example, are six-packs of KOOL-AID BURSTS®.

Before describing the method and apparatus for forming display case 54, the basic construction of shroud 12 will be described. Shroud 12 is formed from a one-piece, die-cut blank 10 of corrugated board or the like as depicted in FIGS. 1 and 4–6. It will be appreciated that die-cut blank 10 is foldable to form shroud 12 in a continuous operation which is depicted as a sequence of steps for clarity in FIGS. 4–6. As depicted, the steps of transforming blank 10 include forming a blank 10' and then a partially formed shroud 12' (also shown in FIG. 2) before the fully formed shroud 12 (also shown in FIG. 3) is produced.

Blank 10 includes a central top panel 18 which is designed to form a top of shroud 12. Top panel 18 is generally rectangular in shape and thus defines a pair of first sides **20*a* and 20*b* extending parallel to an x-axis and a pair of second sides 22*a* and 22*b* extending parallel to a y-axis. A z-axis is oriented to be perpendicular to an x-y plane formed by the x-axis and the y-axis. It will be appreciated that axes x, y and z are used as a convenient reference for describing the elements and locations thereof of the present invention and that these axes are not otherwise part of the blank 10** or of the invention.

Blank 10 also includes a pair of rectangular side panels **24*a* and 24*b*. As side panels 24*a* and 24*b* are otherwise identical, only side panel 24*a* will be described in detail, with the similar elements of side panel 24*b* being depicted with the same identifying numbers but with a "b" suffix rather than an "a" suffix. Side panel 24*a* includes a hinge or score line 26*a* parallel to the x-axis attaching side panel 24*a* foldably along hinge line 26*a* to first side 20*a* of top panel 18** along a length thereof.

Each side panel **24*a* and 24*b* also includes a respective pair of rectangular projecting portions 28*a* and 28*b* which are also identical to one another so that only one projecting portion 28*a* is described in detail. Projecting portion 28*a* extends parallel to the x-axis from side panel 24*a* and beyond the adjacent first side 20*a* or 20*b*. Each projecting portion 28*a* includes a second hinge or score line 30*a* parallel with the y-axis foldably attaching projecting portion 28*a* to side panel 24*a*. In addition, each projecting portion 28*a* also includes a perforated hinge or score line 32*a* parallel to the y-axis. Perforated hinge line 32*a* divides projecting portion 28*a* into a reinforcing panel 34*a* and a leg panel 36*a*, and the perforations of hinge line 32*a* make it possible to more easily fold leg panel 36***a* 90° thereabout relative to reinforcing panel 34*a* (or parallel to the z-axis) as shown by blank 10' in FIGS. 4–6. It will be appreciated that reinforcing panels 34*a* extend parallel to the x-axis for a distance which is slightly (typically by a little more than the thickness of leg panel 36*a*) less than ½ of the distance that side panel 24*a* extends along the x-axis. Thus, when reinforcing panels 34*a* of side panel 24*a* are bent back onto side panel 24*a* along hinge lines 30*a* as shown by partially formed shroud 12' and shroud 12 in FIGS. 2–6, leg panels 36*a* are bent perpendicular to reinforcing panels 34*a* along hinge lines 32*a* to come together and to form a (double thick) leg 38*a*.

Blank 10 further includes squaring panels 40*a* and 40*b* attached to a respective second side 22*a* or 22*b* along a respective hinge or score line 42*a* or 42*b* which is parallel to the y-axis. When squaring panels 40*a* and 40*b* are bent along hinge lines 42*a* and 42*b* first 90° as shown by blank 10' and then back onto top panel 18 as shown by partially formed shroud 12' and shroud 12 in FIGS. 2–6, squaring panels 40*a* and 40*b* serve to strengthen top panel 18 and help top panel 18 maintain its rectangular shape and thus to help the formed shroud 12 and assembled display case 54 maintain squareness. It will also be appreciated that a space 44*a* or 44*b* is provided between sides of reinforcing panels 34*a*, 34*b* adjacent to sides of squaring panels 40*a*, 40*b* to provide room for forming of shroud 12 as shown best in FIG. 3.

Figure 1:
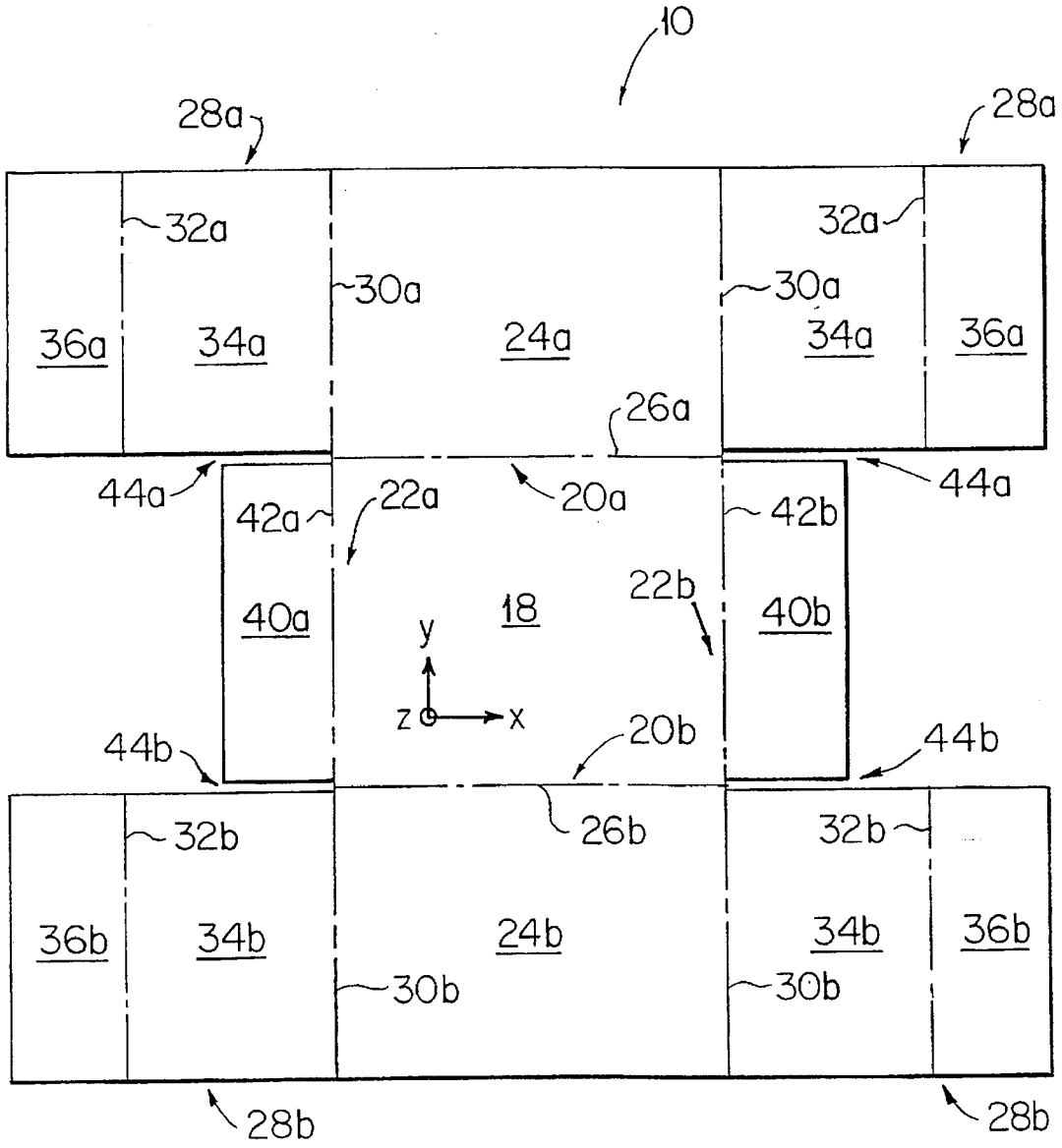
FIG. 1 is a bottom plan view of a one-piece blank from which a shroud is erected according of the present invention.
Figure 2:
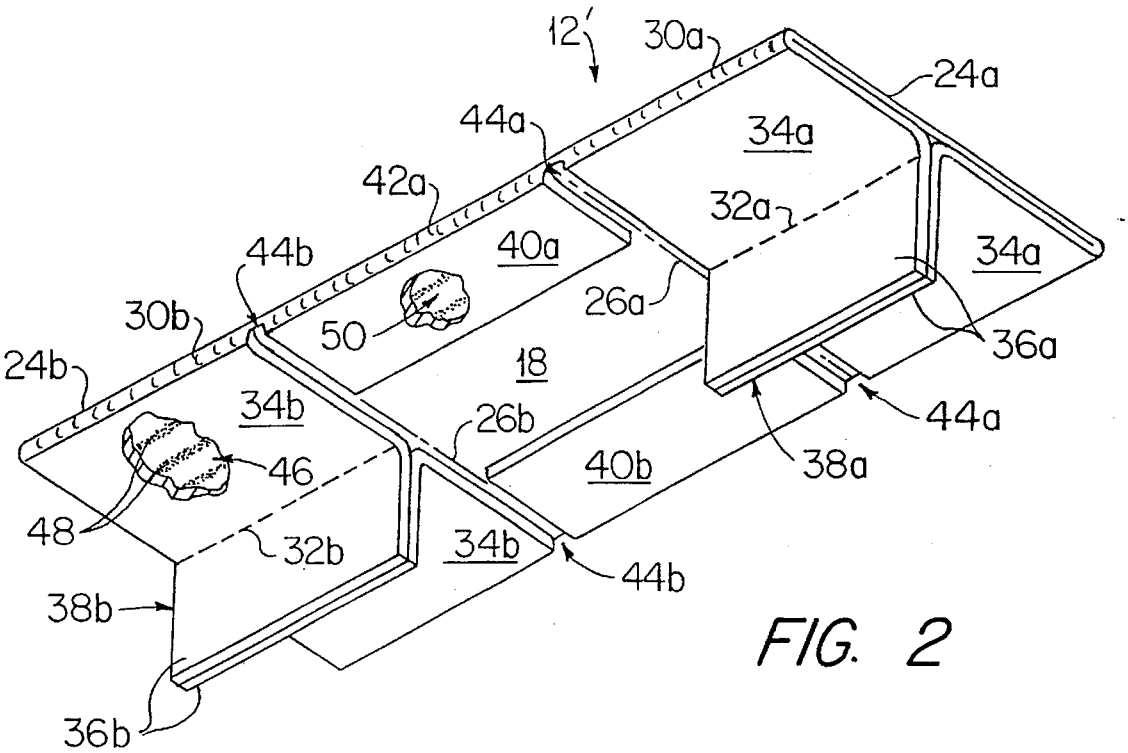
FIG. 2 is a bottom perspective view with portions broken away of the one-piece blank depicted in FIG. 1 folded into a partially formed shroud having a pair of opposed T-shaped panels according to the present invention.

Depicted best in FIG. 2 is partially formed shroud 12' which has been partially formed from the sequence of blanks 10 and 10'. As shown, reinforcing panel 34*b* on the left side of the figure (as well as the other reinforcing panels 34*a* and 34*b*) has been bent back along hinge line 30*b* onto side panel 24*g* and immovably secured to the overlying portion of side panel 24*g* by a securing means 46. Securing means 46 is suitably a series of hot melt adhesive or glue strips 48 where shroud 12 is made of a corrugated board material, though obviously other securing means known in the art could also be used. In a similar manner, it will be appreciated that squaring panels 40*a* and 40*b* are immovably secured to the overlying portion of top panel 18 by a securing means 50, and that leg panels 36*a* and 36*b* are resiliently held against one another by the resistance to bending occurring at hinge lines 32*a* and 32*b*.

While shroud 12 is capable of serving as a protective top and side for array 14 of packages 16 if packages 16 have a suitable bottom, shroud 12 is preferably used as part of overall display case 54 depicted in an exploded configuration in FIG. 3. As noted above, display case 54 includes shroud 12. Shroud 12 is configured from the partially formed shroud 12' depicted in FIGS. 2 and 4–6 by the bending of opposed T-shaped reinforced panels (comprised of side panels 24*a* and 24*b*, reinforcing panels 34*a* and 34*b* secured thereto, and legs 38*a* and 38*b* formed as discussed above) along hinge lines 26*a* and 26*b*, respectively, to form shroud 12 into its final shape. During this final bending along hinge lines 26*a* and 26*b*, it will be appreciated that spaces 44*a* and 44*b* provide clearance between the adjacent side edges of reinforcing panels 34*a*, 34*b* and of squaring panels 40*a*, 40*b* so that there is no interference between these side edges as the folding takes place.

Display case 54 additionally includes bottom tray 56 which is also suitably formed of a corrugated board material in any manner well known in the art. Bottom tray 56 includes a bottom 57 as well as four upstanding sides 58*a*, 58*b*, 58*c* and 58*d*. It will be appreciated that bottom tray 56 is sized to receive array 14 therein with clearance between upstanding sides 58*a* and 58*b* of bottom tray 56 and the adjacent sides of array 14 so that side panels 24*a* and 24*b* can fit between upstanding sides 58*a* and 58*b* of bottom tray 56 and the sides of array 14. In addition, while array 14 is formed overall as a 4×2 array of eight packages 16, it will be seen that array 14 is divided into two 2×2 arrays to accommodate the insertion of legs 36*a* and 36*b*. Thus, small space 60 is centrally created between the two 2×2 arrays in which legs 36*a* and 36*b* are trapped. Finally, display case 54 is completed by suitably securing array 14, shroud 12 and bottom tray 56 together with a suitable securing means 62 known in the art. A suitable securing means 62 is a shrink wrap sleeve 64 shown in the unshrunken condition in FIG. 3, although other securing means such as full shrink wrap, straps or the like could also be used.

Figure 7:
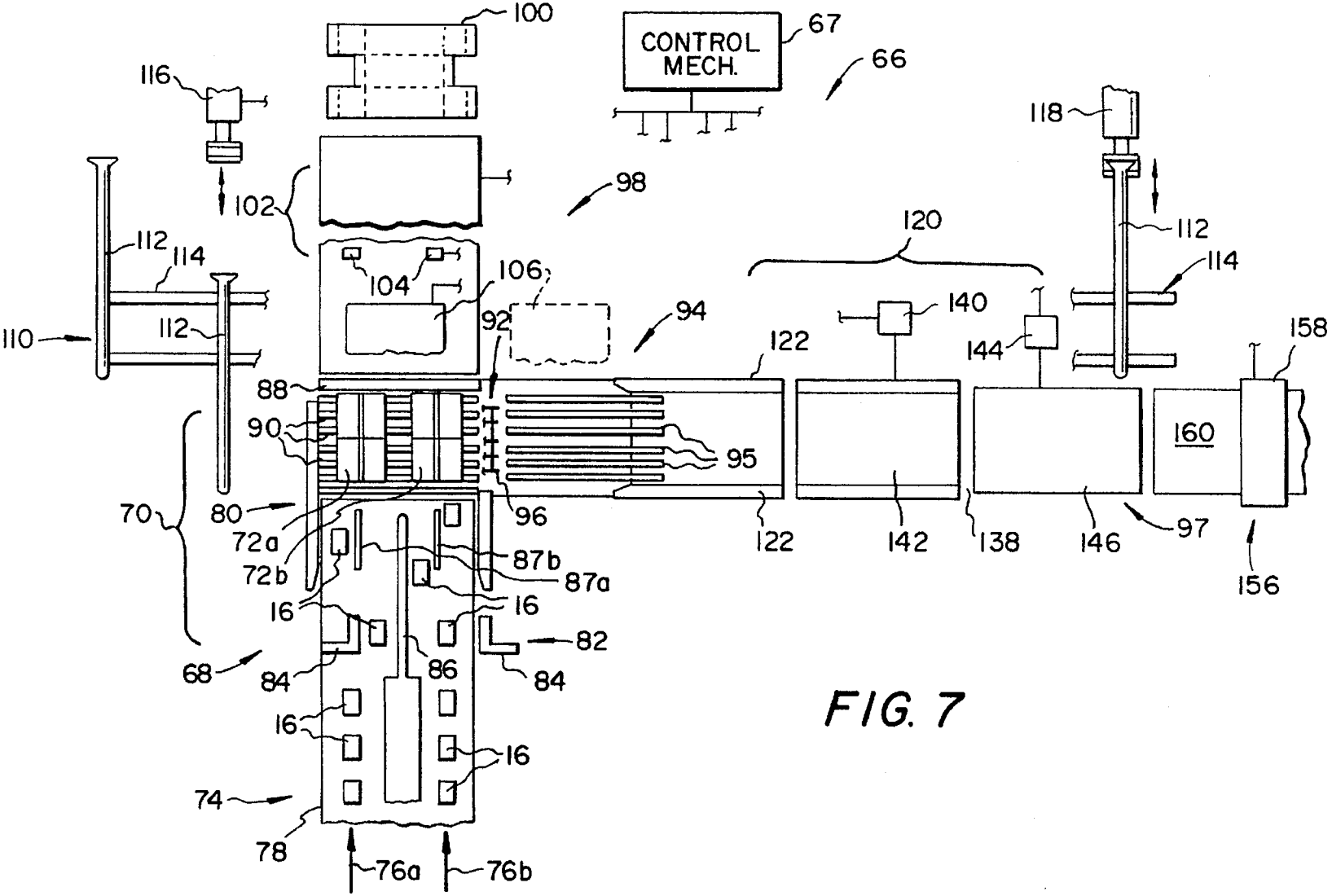
FIG. 7 is schematic plan view of an automated system for producing display cases of the present invention.

Depicted in FIG. 7 is an automated system 66 for producing display cases 54 of packages 16. A computer of other control mechanism 67 for system 66 is only shown schematically and with schematic connections as such control mechanisms are well known in the art for coordinating the various mechanisms and movements associated with system 66, and for sensing disruptions and malfunctions of mechanisms and movements or the absences of necessary elements. System 66 includes an assembling means 68 for assembling successive arrays 14 of packages 16 at an assembling station 70. It will be appreciated that assembling means 68 assembles each array 14 so as to be split into first and second portions 72*a* and 72*b* with space 60 therebetween. Assembling means 68 includes a conducting means 74 for conducting first and second lines 76*a* and 76*b* of packages 16 to assembling station 70. Conducting means 74 preferably includes a single table top conveyor 78 for conveying first and second (double file) lines 76*a* and 76*b* of packages 16 as well known in the art.

At a downstream end of lines 76*a* and 76*b*, there is a forming means 80 for forming the respective first and second portions 72*a* and 72*b* of array 14 with space 60 therebetween. Forming means 80 forms array 14 from packages 16 conducted by the respective first and second lines 76*a* and 76*b* of conveyor 78. Forming means 80 includes a configuring means 82 for configuring of the first and second portions 72*a* and 72*b* with packages 16 having a 2×2 configuration. Configuring means 82 includes two pushers 84, each pusher 84 being alternately actuated (such as by hydraulic actuators not shown for clarity) to push every other package 16 of associated line 76*a* or 76*b* passing thereby on conveyor 78 against a stop 86. In this manner, configuring means 82 causes alternate packages 16 to be forwarded on opposite sides of a separator 87*a* or 87*b* onto advancing rollers 90. Packages 16 then finally stop against a stop 88 or a previously deposited package 16, so that first and second portions 72*a* and 72*b* are automatically configured as 2×2 groups with space 60 therebetween corresponding approximately to the thickness of stop 86.

From assembling station 70, both first and second portions 72*a* and 72*b* are moved by a first moving means 92 with space 60 maintained therebetween to a covering station 94. Preferably, first moving means 92 moves the first and second portions 72*a* and 72*b* perpendicular to first and second lines 76*a* and 76*b* to a slideway 97. This is conveniently performed by use of a walking beam conveyor 96 (only partially shown for clarity) which moves in a more or less rectangular motion between rollers 90 and finger extensions 95 of slideway 97 located at covering station 94 as well appreciated by those of ordinary skill in the art.

At the same time that each successive array 14 is being formed in assembling station 70, a forming means 98 is used for successively forming each shroud 12 to cover a top and two opposed first sides of the associated array 14 of packages 16 while leaving two opposed second sides of the array uncovered. Forming means 98 includes a stack 100 of blanks 10 located at an upstream end thereof. Individual blanks 10 are picked up and initially bent by an initial bending means 102. Initial bending means 102 bends each blank 10 so that a partially-formed shroud 12' is produced having a top panel 18 and two opposed side panels 24*a* and 24*b* formed in a horizontal plane together with legs 38*a* and 38*b* extending perpendicularly from the plane in the middle of each side panel 24*a* and 24*b* as shown in FIG. 2.

Figure 4:
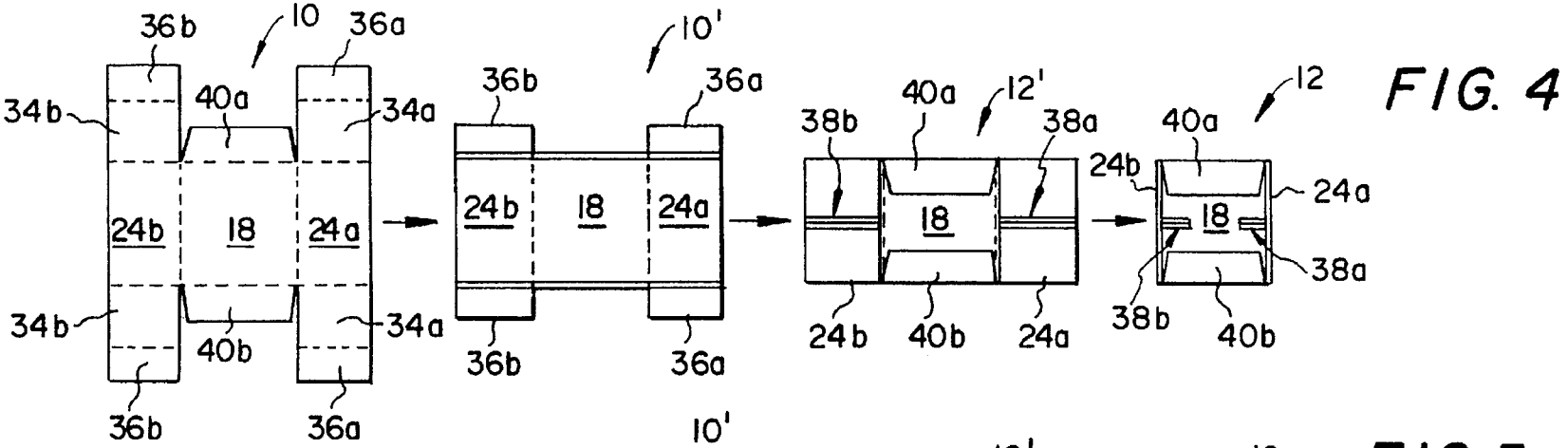
FIGS. 4–6 are schematic depictions of a forming sequence of the shroud of the present inventions shown in bottom, front and right side views respectively.
Figure 5:
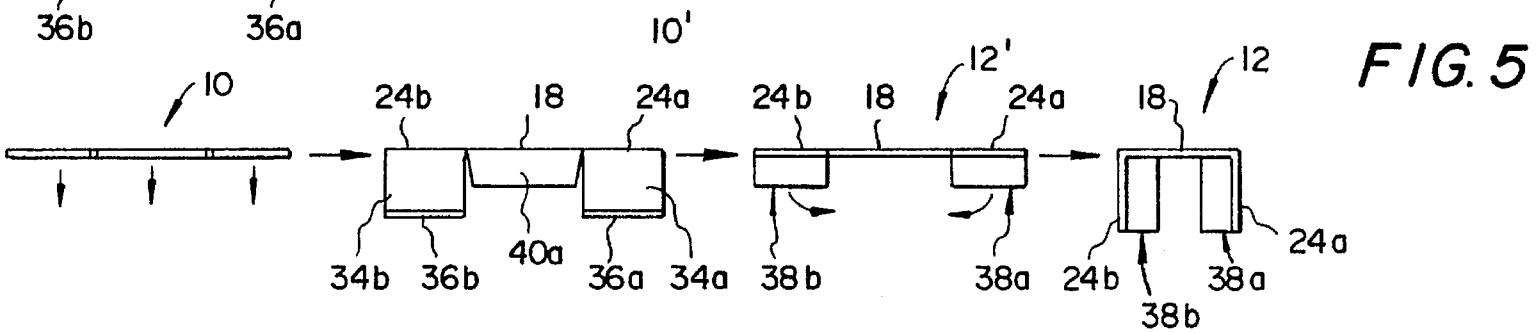
Figure 6:
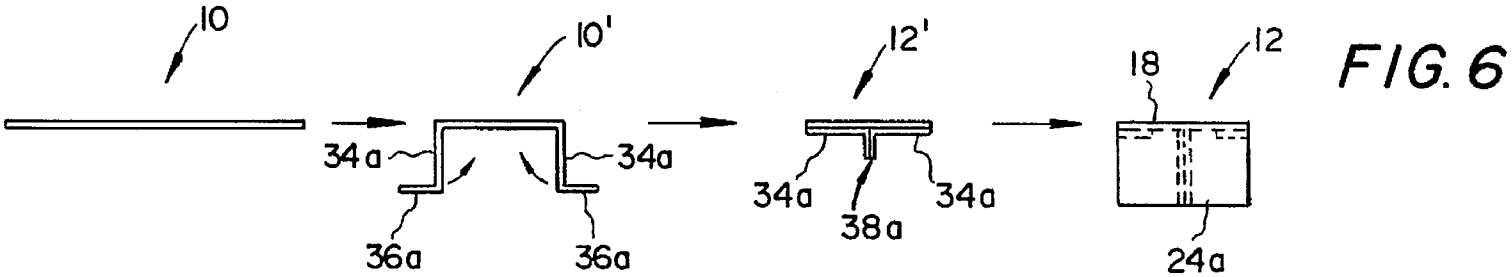

Conveniently, initial bending means 102 includes suitable opposed compression driving belt conveyors and associated ramp or folding guides (not shown) which are well known the art for smoothly bending blanks as required. With initial bending means 102, in a first sequence: (a) each reinforcing panel 34*a* and 34*b* attached to each associated side panel 24*a* and 24*b* is first bent perpendicular to the associated side panel 24*a* and 24*b*; (b) each leg panel 36*a* and 36*b* attached to each reinforcing panel 34*a* and 34*b* is bent perpendicular to the associated reinforcing panel 34*a* and 34*b*; and (c) each respective squaring panel 40*a* and 40*b* attached to respective opposite sides of top or central panel 18 are bent perpendicular to the top panel 18. This step in the forming of shroud 12 is depicted in FIGS. 4–6 by the transition of blank 10 to blank 10'.

After the first sequence, with blank 10' configured as noted, a glue means 104 (depicted schematically but suitably part of a NORDSON 2300 gluing and compression station) suitably stationed in initial bending means 102 applies glue to one of each reinforcing panel 34*a* and 34*b* or to each side panel 24*a* and 24*b* at a position adjacent each reinforcing panel 34*a* and 34*b*. Glue means 104 also applies glue to one of each squaring panel 40*a* and 40*b* or both opposite sides of top panel 18 adjacent thereto. For convenience, glue means 104 preferably applies glue to reinforcing panels 34*a* and 34*b* and to squaring panels 40*a* and 40*b*.

In the next sequence, initial bending means 102 bends and presses each reinforcing panel 34*a* and 34*b* attached to each associated side panel 24*a* and 24*b* into glued attachment with the associated side panel 24*a* and 24*b*. This movement also causes adjacent leg panels 36*a* and adjacent leg panels 36*b* to be facing against one another and to be resiliently held in this position by the resistance to bending of hinge lines 32*a* and 32*b* to form legs 38*a* and 38*b*. At the same time, each squaring panel 40*a* and 40*b* is similarly bent into position adjacent top panel 18 and press glued thereto. This configuration of partially formed shroud 12' is shown in FIGS. 2 and 4–6. Partially formed shroud 12' is preferably delivered by initial bending means 102 to a position above a (preferably) simultaneously formed array 14 positioned against stop 88 in assembly station 70.

Forming means 98 also includes a final bending means 106 located at a downstream end of initial bending means 102 and extending over first and second portions 72*a* and 72*b* (the extending portion is not depicted in FIG. 7 for clarity) from an overhead frame 103. Final bending means 106 is best shown in FIG. 8 and is used for finally bending and locating partially formed shroud 12' relative to first and second portions 72*a* and 72*b* of array 14 at covering station 94. In FIG. 8, it will be appreciated that side panel 24*a* has been removed to show the folding movement and positions of side panel 24*b* and leg 38*b* (which otherwise would be blocked from view) relative to first and second portions 72*a* and 72*b*, and that the movement of side panel 24*b* is mirrored by side panel 24*a*. By use of final bending means 106, a covered array 14' is provided with legs 38*a* and 38*b* of side panels 24*a* and 24*b* located in space 60 while top panel 18 and side panels 24*a* and 24*b* cover a majority of the respective top and first sides of array 14.

Final bending means 106 picks up partially formed shroud 12' with a suction member 108 or the like located above the position of top panel 18 when shroud 12' is delivered to the downstream end of initial bending means 102, as indicated schematically by the double ended arrow. It will be appreciated that partially formed shroud 12' is delivered by initial bending means 102 to a position where top panel 18 located above first and second portions 72*a* and 72*b*. Then, as walking beam conveyor 96 moves array to covering station 94, final bending means 106 is indexed or controlled to similarly move partially formed shroud 12' at the same time along frame 103 (as indicated by final bending means 106 shown in phantom at this new position). At covering station 94, final bending means 106 bends side panels 24*a* and 24*b* into position by suitable pivoted and pneumatically actuated flaps or arms (not shown) attached to suction member 108 to convert partially formed shroud 12' into shroud 12 above first and second portions 72*a* and 72*b* at covering station 94. Final bending means 106 then (pneumatically) lowers fully formed shroud 12 around first and second portions 72*a* and 72*b* with legs 38*a* and 38*b* in space 60 between first and second portions 72*a* and 72*b* and top panel 18 adjacent but spaced from the fragile tops of the packages 16 due to the selected height of side panels 24*a* and 24*b*.

While shroud 12 is held in place on array 14, a pushing means 110 is used for pushing first and second portions 72*a* and 72*b* of array 14 together inside of shroud 12 so that top panel 18 and side panels 24*a* and 24*b* cover all of the respective top and first sides of array 14 to form a completely covered array 14'. In this embodiment, pushing means 110 includes a plurality of extendable and then retractable arms 112 which are moved parallel to a longitudinal axis of slideway 97. It will be appreciated that arms 112 are moved parallel to the axis of slideway 97 by a chain driven conveyor 114 or the like, and are also moved from an extended position which begins adjacent assembly station 70 and slightly above slideway 97 to a retracted position as at an end of slideway 97 where arm 112 is retracted and returned by a return path of conveyor 114 to assembly station 70. Conveyor 114 for the movement of arms 112 as well as an extender 116 and a retractor 118 for arms 112 are only schematically and partially depicted for clarity as these elements are well known in the art.

As shown in FIGS. 7 and 8, arm 112 is moved from the retracted to the extended position adjacent assembly station 70. Conveyor 114 is indexed or otherwise suitably controlled with the movement of final bending means 106 and walking beam conveyor 96 to move therewith, so that extended arm 112 moves across assembly station 70 as array 14 is moved therefrom. Thereafter, with covered array 14' formed by final bending means 106, arm 112 is moved laterally against a distal end of first portion 72*a* distant from a finishing station 120 downstream along slideway 97 as shown in FIG. 8. With this movement toward the finishing station by arm 112, first and second portions 72*a* and 72*b* are gathered or pushed together under shroud 12 as noted above to form completely covered array 14' and covered array 14' is then moved by a further movement of arm 112 to finishing station 120.

At the start of finishing station 120 are a pair of converging guides 122. As arm 112 pushes covered array 14' from final bending means 106, sides panels 24*a* and 24*b* are held against array 14 by the flaps of final bending means 106 until side panels 24*a* and 24*b* engage with a respective guide 122.

Thus, when covered array 14' leaves final bending means 106, side panels 24*a* and 24*b* are held in place against or closely adjacent array 14 by guides 122. In the same manner, an overhead pressing means 124, preferably in the form of a converging guide 126 (omitted for clarity from FIG. 7), presses down and holds top panel 18 in place with side panels 24*a* and 24*b* engaged with (or closely adjacent to) the uppermost surface of slideway 97 as top panel 18 exits from under suction member 108. After covered array 14' exits from final bending means 106, final bending means 106 and walking beam conveyor 98 are returned to assembling station 70.

Subsequent positions of covered array 14' are depicted in FIG. 8 in phantom along slideway 97 to give some idea of the basic flow of covered array 14' through finishing station 120. However, the sequence of steps for completing display case 54 in finishing station 120 are more fully and accurately depicted in FIGS. 9*a*–9*e*. In FIGS. 9*a–e*, many other details have been left off for clarity, and both shroud 12 and tray 56 have been depicted in vertical cross section so that the movement of packages 16 and other elements therein can be seen.

Broadly, finishing station 120 also includes a placing means 128 for placing covered arrays 14' in trays 56 having bottom 57 and upstanding sides 58*a–d*. Placing means 128 includes a positioning means 130 for positioning trays 56 underneath of a path of movement of successive covered arrays 14', and ultimately with a leading upstanding side 58*d* of each successive tray 56 being in the path of movement. As noted above, arm 112 of pushing means 110 is used to push array 14 together under shroud 12. In addition, pushing means 110 also acts as a moving means for moving covered array 14 to and through finishing station 120. It will be appreciated that this movement defines a leading edge 134 of second portion 72*b* and a trailing edge 136 of first portion 72*a*. Pushing means 110 thus moves leading edge 134 of second portion 72*b* into leading side 58*d* of tray 56 so that the further movement of covered array 14' causes tray 56 to be picked up from positioning means 130 and moved along underneath covered array 14 '.

Figure 9A:
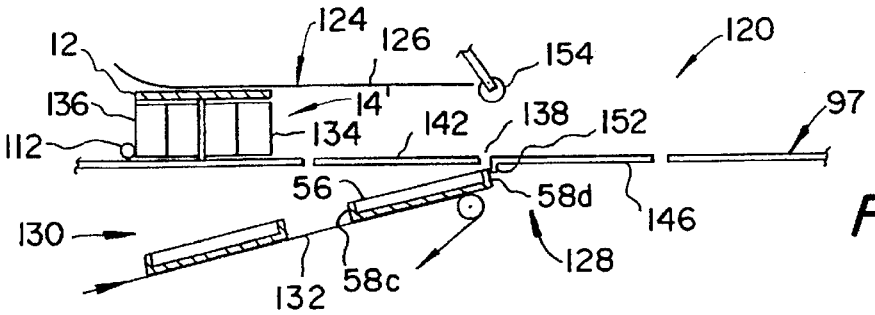
Figure 9B:
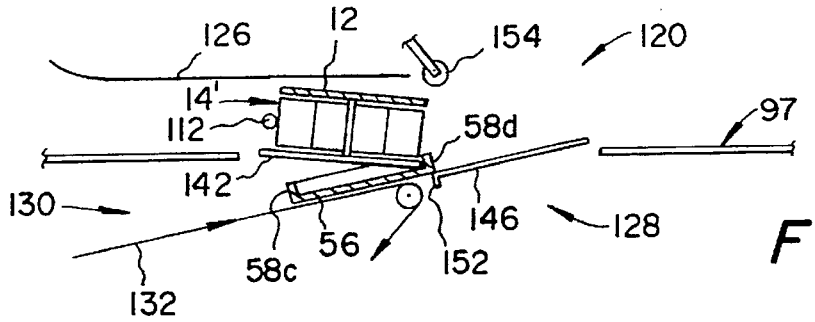
Figure 9C:
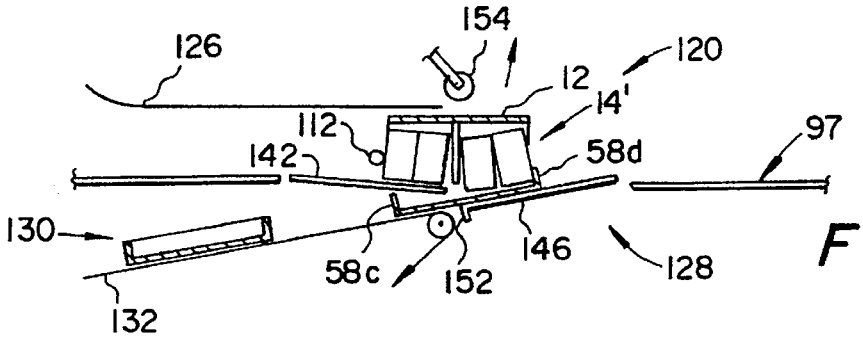

To accomplish the above noted movements of covered array 14' and tray 56, positioning means 130 in particular includes a feeding means or conveyor 132 for feeding a tray 56 for a covered array 14' from below and to a gap 138 in horizontal slideway 97 along which covered array 14' is moved. Preferably, leading side 58*d* of tray 56 is uppermost and located at gap 138 as leading edge 134 of covered array 14' approaches as shown in FIG. 9*a*. Then, a first tilting means 140 tilts an upstream (relative to gap 138) portion 142 of slideway 97 on which covered array 14' is then located downwards (or clockwise as viewed) into tray 56 therebelow as shown in FIG. 9*b* as covered array 14' approaches upstream portion 142. This assures a full engagement of leading side 58*d* by leading edge 134 of covered array 14' when contact is made. Shortly after upstream portion 142 is tilted, a second tilting means 144 tilts a downstream portion 146 of slideway 97 relative to gap 138 upwards (or counterclockwise) as shown in FIG. 9*b* and is so positioned when leading edge 134 of covered array 14' pushes against leading side 58*d* of tray 56. Consequently, as shown in FIG. 9*c*, as tray 56 moves upward through gap 138 and as covered array 14' moves off of upstream portion 142, covered array 14' and tray 56 move upwards along downstream portion 146 of slideway 97. As this occurs, a pressing means 154 moves upward out of the way of shroud 12 as also shown in FIG. 9*c*.

Figure 9D:
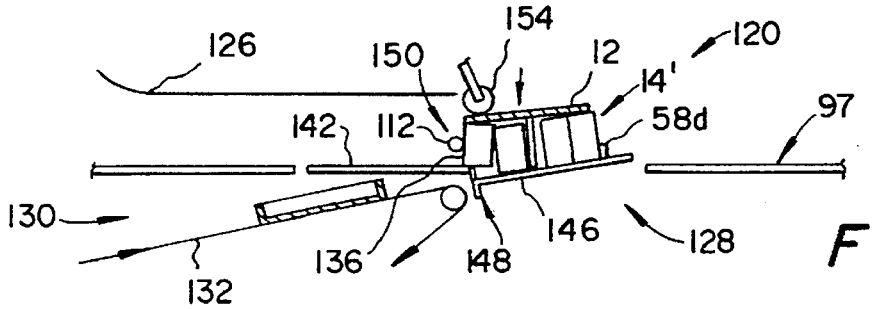
Figure 9E:
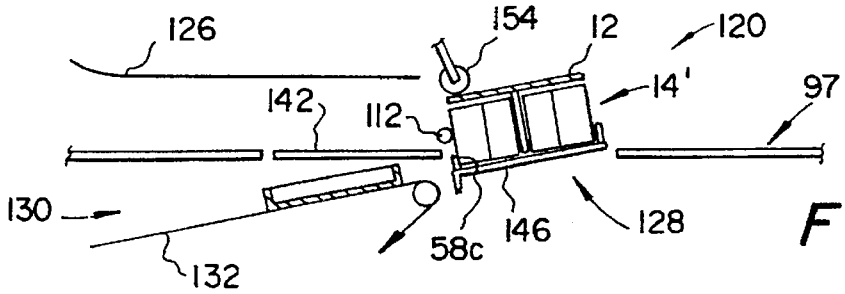

After a majority of covered array 14' and tray 56 are positioned on downstream portion 146, first tilting means 140 tilts upstream portion 142 back to horizontal as shown in FIG. 9*d* so that a subsequent covered array 14' can be received. As this occurs, trailing side 58*c* of tray 56 passes through gap 138 which is thus enlarged and hence can accommodate trailing side 58*c* of tray 56. But as this movement of upstream portion 142 occurs, it causes trailing edge 136 of first portion 72*a* to be raised above and tilted relative to bottom 57 of tray 56 as also shown in FIG. 9*d*. In order to move trailing edge 136 from this position, a dropping means 148 is employed for dropping trailing edge 136 into tray 56 adjacent upstanding trailing side 58*c*. Dropping means 148 is simply a pushing means 150 for pushing trailing edge 136 off of upstream portion 142 onto and past trailing side 58*c* so that trailing edge 136 drops inside of trailing side 58*c* of tray 56 to form display case 54. Conveniently, pushing means 150 is simply a suitable controlled movement of arm 112 already engaging trailing edge 136. As trailing edge 136 drops into tray 56 from the end of upstream portion 142, pressing means 154 is lowered to press down on top panel 18 of shroud 12, assuring that side panels 24*a* and 24*b* which have fully been inserted into tray 56 adjacent leading side 58*d* are now pushed fully into tray 56 along the entire length of upstanding sides 58*a* and 58*b* as well.

After the dropping of trailing edge 136 into tray 56, second tilting means 144 then returns downstream portion 146 of slideway 97 back to horizontal as shown in FIG. 9*a*. Arm 112 of pushing means 110 then pushes fully formed display case 54 off of the downstream end of downstream portion 146 and onto a traveling conveyor 160. Once this is accomplished, arm 112 is moved from the extended position to the retracted position as shown in FIG. 7 by retractor 118 for eventual return to assembly station 70 and use in a new cycle. At this time, feeding means 132 positions another tray 56 against a stop end 152 of downstream portion 14 as also shown in FIG. 9*a*. As the next cycle begins, traveling conveyor 160 moves formed display case 54 from finishing station 120 to a securing station 156 where securing means 62 is applied by a suitable securing device 158 to display case 54 in a manner well known in the art for the selected securing means (and hence depicted only schematically for that reason).

After shrink wrap 64 is shrunk around array 14, shroud 12 and bottom tray 56, it will be appreciated that display case 54 so formed is completed. Display case 54 then has two ends through which packages 16 are easily viewable, either directly or through a transparent, shrink-wrap film.

In addition, packages 16 are also easily accessible by the user, either individually by breaking part of shrink wrap 64 or completely by removing shrink wrap 64 and then lifting shroud 12 from array 14. It will also be appreciated that top panel 18 as well as side panels 24*a* and 24*b* also provide a suitable surface for high quality graphics as desired. It is anticipated that the compression static load (top-bottom) of display case 54 will exceed 1000 pounds.

Prior to removal of shrink wrap 64, display case 54 provides a sturdy container for packages 16 which are stackable. Legs 38*a* and 38*b* are double thickness and trapped between adjacent packages 16, providing obvious vertical support. Further, the double thickness of side panels 24*a* and 24*b* reinforced by reinforcing panels 34*a* and 34*b* also provide vertical support as well as side protection. The overall shape of shroud 12 is also maintained: as central panel is maintained in its rectangular configuration by squaring panels 40*a* and 40*b*, as side panels 24*a* and 24*b* are reinforced by reinforcing panels 34*a* and 34*b* , and as legs 38*a* and 38*b* are trapped in array 14 and engage bottom tray 56 and top panel 18. It will also be appreciated that all eight corners of array are suitably protected by a double thickness of material due to the configuration and location of shroud 12.

While the present invention has been described with respect to exemplary embodiments thereof, it will be understood by those of ordinary skill in the art that variations and modifications can be effected within the scope and spirit of the invention.

What is claimed is:

1. A method for providing a display case for a plurality of packages comprising the steps of:

(a) assembling an array of the packages at an assembling station;

(b) moving the assembled array from the assembling station to a covering station;

(c) forming a shroud for the display case which shroud covers a top and two opposed first sides of the assembled array of packages while leaving two opposed second sides of the assembled array uncovered, said forming step including the steps of:

(i) providing a blank of the shroud;

(ii) initially bending the blank so that a partially-formed shroud is produced having a top panel and two opposed side panels; and (iii) finally bending and locating the partially formed shroud relative to the assembled array at the covering station such that a covered array is provided with the top panel and side panels covering a majority of the respective top and first sides of the array; and (d) placing the covered array in a tray having a bottom and four upstanding sides at a finishing station to provide the display case, wherein said placing step includes the steps of:

(i) moving the covered array to the finishing station so that there is a leading edge and a trailing edge;

(ii) moving the leading edge of the covered array into one of the upstanding sides of the tray constituting a leading side so that the tray is moved along underneath the covered array at the finishing station, said moving the leading edge step including the steps of feeding the tray for the covered array from below and through a gap in a horizontal slideway along which the covered array is moved, the leading side of the tray being uppermost so that the leading edge of the covered array moves into the leading side, tilting an upstream portion of the slideway relative to the gap downwards into the tray therebelow as the leading edge of the covered array approaches the leading side of the tray, tilting a downstream portion of the slideway relative to the gap upwards so that after the leading edge of the covered array pushes against the leading side of the tray the covered array and tray move upwards along the downstream portion of the slideway as the tray moves up through the gap, and tilting the upstream portion back to horizontal as the trailing side of the tray passes through the gap, which causes the trailing edge of the covered array to be raised above the bottom of the tray; and (iii) pushing the trailing edge of the covered array off of the upstream portion of the slideway into the tray so that the trailing edge drops inside of the adjacent upstanding, trailing side of the tray, said trailing side opposite the leading side, to form the display case.

2. A method for providing a display case as in claim 1 wherein the assembled array is split into first and second portions with a space therebetween, the shroud has a leg extending perpendicularly from the middle of each side panel and, upon final bending and locating the partially formed shroud, the leg of each side panel is positioned in the space between the first and second portions of the array.

3. A method for providing a display case as claimed in claim 2 wherein said assembling step includes the steps of:

(a) conducting first and second lines of packages to the assembling station; and (b) forming the respective first and second portions of the array at the assembling station with the space therebetween from the packages conducted by the respective first and second lines.

4. A method for providing a display case as claimed in claim 3:

(a) wherein said conducting step of said assembling step includes the step of conveying the first and second lines of packages along a conveyor double file; and (b) wherein said moving step from said assembling station includes the step of moving the first and second portions perpendicular to the conveyor to the covering station.

5. A method for providing a display case as claimed in claim 2 wherein said final bending step of said forming step includes the steps of:

(a) bending the partially formed shroud into a final form above the first and second portions of the assembled array at the covering station; and (b) lowering the shroud onto the first and second portions with the legs in the space between the first and second portions and the top panel adjacent to a top of the packages of the first and second portions.

6. A method for providing a display case as claimed in claim 1 which further comprises:

(a) returning the downstream portion of the slideway back to horizontal; and (b) moving the formed display case from the finishing station along the slideway.

7. A method for providing a display case as claimed in claim 1 wherein said placing step further includes the step of pressing down on the top panel of the shroud as the trailing edge of the covered array drops into the tray.

8. An apparatus for providing a display case for a plurality of packages comprising:

(a) an assembling means for assembling an array of the packages at an assembling station;

(b) a first moving means for moving the assembled array from said assembling station to a covering station;

(c) a forming means for forming a shroud for the display case which shroud covers a top and two opposed first sides of the assembled array of packages while leaving two opposed second sides of the assembled array uncovered, said forming means including:

(i) means for providing a blank of the shroud;

(ii) an initial bending means for initially bending the blank so that a partially-formed shroud is produced having a top panel and two opposed side panels; and (iii) a final bending means for finally bending and locating the partially formed shroud relative to the assembled array at the covering station such that a covered array is provided with the top panel and side panels covering a majority of the respective top and first sides of the assembled array; and (d) a placing means for placing the covered array in a tray having a bottom and four upstanding sides at a finishing station to provide the display case, wherein said placing means includes:

(i) a positioning means for positioning the tray underneath of a path of movement of the covered array and with one of the upstanding sides of the tray constituting a leading side being in the path of movement, wherein said positioning means includes a feeding means for feeding the tray for the covered array from below and through a gap in a horizontal slideway along which the covered array is moved, the leading side of the tray being uppermost so that the leading edge of the covered array moves into the leading side;

(ii) a second moving means for moving the leading edge of the covered array to the finishing station and for moving said leading edge into the leading side of the tray so that the tray is picked up from the positioning means and moved along underneath the covered array, said second moving means including a first tilting means for tilting an upstream portion of the slideway relative to the gap downwards into the tray therebelow as the leading edge of the covered array approaches the leading side of the tray, a second tilting means for tilting a downstream portion of the slideway relative to the gap upwards so that, after the leading edge of the covered array pushes against the leading side of the tray, the covered array and tray move upwards along the downstream portion of the slideway as the tray moves up through the gap, and wherein said first tilting means also tilts the upstream portion back to horizontal as the trailing side of the tray passes through the gap, which causes the trailing edge of the covered array to be raised above the bottom of the tray; and (iii) a dropping means for dropping the trailing edge of the covered array into the tray adjacent the upstanding, trailing side of the tray, said trailing side being opposite the leading side, said dropping means including a pushing means for pushing the trailing edge of the covered array off of the upstream portion of the slideway so that the trailing edge of the covered array drops inside of the trailing side of the tray to form the display case.

9. An apparatus for providing a display case as claimed in claim 8 wherein said assembling means includes a conducting means for conducting first and second lines of packages to the assembling station and an array forming means for forming the assembled array into first and second portions with a space therebetween.

10. An apparatus for providing a display case as claimed in claim 9:

(a) wherein said conducting means of said assembling means includes a conveyor for conveying the first and second lines of packages double file thereon; and (b) wherein said first moving means moves the first and second portions perpendicular to the conveyor to the covering station.

11. An apparatus for providing a display case as claimed in claim 10 wherein said final bending means of said forming means:

(a) bends the partially formed shroud into the shroud above the first and second portions at the covering station; and (b) lowers the shroud onto the first and second portions with the top panel adjacent to a top of the packages of the first and second portions.

12. An apparatus for forming a display case as claimed in claim 8 wherein:

(a) said second tilting means of said positioning means also returns the downstream portion of the slideway back to horizontal; and (b) said second moving means of said placing means also moves the formed display case from the finishing station along the slideway.

13. An apparatus for providing a display case as claimed in claim 9 wherein said placing means further includes a pressing means for pressing down on the top panel of the shroud as the trailing edge of the other portion drops into the tray.

* * * * *